US008950102B1

(12) United States Patent
Reardon et al.

(10) Patent No.: US 8,950,102 B1
(45) Date of Patent: Feb. 10, 2015

(54) SCOPE CORRECTION APPARATUSES AND METHODS

(75) Inventors: Patrick J. Reardon, Madison, AL (US); Christopher N Underwood, Huntsville, AL (US); Theodore E. Rogers, Huntsville, AL (US); Robert D. Ferris, Mesa, AZ (US)

(73) Assignee: The Board of Trustees of the University of Alabama, Huntsville, AL (US)

( * ) Notice: Subject to any disclaimer, the term of this patent is extended or adjusted under 35 U.S.C. 154(b) by 0 days.

(21) Appl. No.: 13/446,939

(22) Filed: Apr. 13, 2012

(51) Int. Cl.
*F41G 1/54* (2006.01)
*F41G 1/38* (2006.01)

(52) U.S. Cl.
CPC ... *F41G 1/54* (2013.01); *F41G 1/38* (2013.01)
USPC ..... 42/120; 42/124

(58) Field of Classification Search
CPC ..... F41G 1/54; F41G 1/545; F41G 1/38
USPC ..... 42/120, 121, 124, 127
See application file for complete search history.

(56) References Cited

U.S. PATENT DOCUMENTS

| | | | | |
|---|---|---|---|---|
| 6,295,754 | B1 * | 10/2001 | Otteman et al. | 42/124 |
| 2003/0177685 | A1 | 9/2003 | Pinkley | |
| 2004/0231220 | A1 | 11/2004 | McCormick | |
| 2005/0233284 | A1 | 10/2005 | Traykov et al. | |
| 2006/0201047 | A1 | 9/2006 | Lowrey, III | |
| 2007/0214699 | A1 * | 9/2007 | Sne et al. | 42/111 |
| 2009/0049733 | A1 * | 2/2009 | Matthews | 42/122 |
| 2011/0207089 | A1 | 8/2011 | Lagettie et al. | |
| 2012/0307356 | A1 | 12/2012 | Xu et al. | |

* cited by examiner

*Primary Examiner* — Stephen M Johnson
(74) *Attorney, Agent, or Firm* — Maynard, Cooper & Gale, P.C.; Jon E. Holland

(57) ABSTRACT

A scope correction apparatus comprises at least one lens and is positioned on a weapon in front of a reticled scope. Such scope correction apparatus receives light from a scene that is located a relatively short distance from the scope such that, without the presence of the scope correction apparatus, the focal point of the light within the scope would not be overlaid with the scope reticle. The scope correction apparatus optically alters the light such that its focal point is overlaid with the scope reticle thereby correcting for optical aberrations caused by the short distance between the scene and the scope. Accordingly, the user is able to view through the scope clear images of both the scene and the reticle.

13 Claims, 4 Drawing Sheets

SCOPE CORRECTION APPARATUSES AND METHODS

RELATED ART

Reticled scopes are often used on weapons, such as rifles, to provide a user with a magnified image of a target. A reticled scope typically has a reticle positioned within the scope, and the reticle overlays a cross-hair or similar fiducial (e.g., a dot) onto the magnified image of the target. Properly overlaying the reticle with the target helps to ensure that the weapon is aimed at the target. Furthermore, failing to present a clear image of both the reticle and the target often results in parallax, which alters the apparent relative positions of the reticle and the target possibly resulting in faulty aiming. Thus, it is desirable for both the reticle and the target to be in focus within the scope.

Indoor ranges are sometimes used wherein a scene showing a target is presented on a wall or screen. Use of reticled scopes at such ranges is often problematic due to the fact that the scope is usually designed to magnify images from great distances, but the scene projected on the wall is actually located a relatively short distance from the user. As an example, in an indoor facility, the size of a target within a scene rendered on a wall may be controlled in size such that the target appears to be a great distance (e.g., 100 feet or more) from the user while the distance to the wall may actually be much shorter (e.g., less than 20 feet from the user). Since the scope is designed to view images from distances greater than that of the wall, the reticle is typically not in the same plane with light received from the wall. Many scopes allow movement of an eyepiece for enabling the scope to bring the images of scenes from various distances into focus, but such scopes often do not have the focus range to provide a clear image on the short distances common with indoor simulators. In addition, few scopes provide adjustment for reticle focus. Thus, even in situations where the user can adjust the position of an eye piece to bring the images of a scene at a relatively short distance into focus, the user is often unable to focus on both the scene image and the reticle image undesirably causing at least one of such images to appear blurry to the user.

Simulation training for small arms is becoming more important as government budgets are tightened and live ranges are closed for environmental or other reasons. At the same time, many users of firearms prefer to use scopes that optically magnify distance targets and give them an advantage in life-or-death engagements. A common axiom is that simulation training is most effective when a person uses the same equipment during simulation training, such as scope, as the equipment they will use in the real world. The problem is that real scopes, as described above, are normally designed for distance shooting and are not designed to focus on a projected image at a relatively short distance, such as about 20 feet, in front of the scope without encountering the difficulties described above.

One recent solution inserts a very small video screen (such as LCD) into a custom device that emulates a real scope. A method of tracking is used to determine where the scope is pointed and the system then supplies the user with the appropriate view. One of the main problems with this approach is that users report a lag—a time delay between moving the rifle/scope and having the view update. The introduction of a noticeable delay in shooting simulation is unacceptable for many users. Another potential error in this method is positional or angular error in tracking the emulated scope, leading to errors in the lessons and muscle memory acquired during training—which can lead to a tragic condition of "negative training." Another problem with the emulated equipment is that the optical clarity and the scope reticle do not match the real world equivalent, further decreasing the realism of the training experience. Finally, using this approach means that each custom device that emulates one particular make and model scope is expensive to develop and manufacture.

A device, referred to as Scope-to-Sim™, overcomes the limitations of the emulated equipment with a video screen approach. First, this device has no lag as it is using the graphics displayed of the virtual world and is not a separate video which must be 'tracked' to match the virtual world. Second, the device requires no tracking, instead the user looks through it just as they would a normal scope. Third, the optical clarity and scope reticle both match that of the real world equipment since the device uses the actual real world requirement. Also, to support different model scopes or different distances, the device could be affordably adjusted and require little additional engineering work and little to no change in manufacturing. Of course, as the magnification of the scope increases, this approach requires more and more pixel density to avoid the user seeing a "screen-door effect" when looking through the scope. However, this is seen as a short-term limitation as technological advances continue to increase pixel density and reduce cost. Also, software is now available to allow for the combining of multiple affordable projectors to obtain very high pixel density. Lastly, there are additional benefits for having a high-pixel density simulation display such as improved realism for all other non-scope related simulation training.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

Embodiments of the present disclosure generally pertain to scope correction apparatuses and methods. An exemplary embodiment of a scope correction apparatus comprises at least one lens and is positioned on a weapon in front of a reticled scope. Such scope correction apparatus receives light from a scene that is located a relatively short distance from the scope such that, without the presence of the scope correction apparatus, the focal point of the light within the scope would not be overlaid with the scope reticle. The scope correction apparatus optically alters the light such that its image inside the scope is overlaid with the scope reticle thereby correcting for mis-focus caused by the short distance between the scene and the scope. Accordingly, the user is able to view through the scope clear images of both the scene and the reticle.

Figure 1:
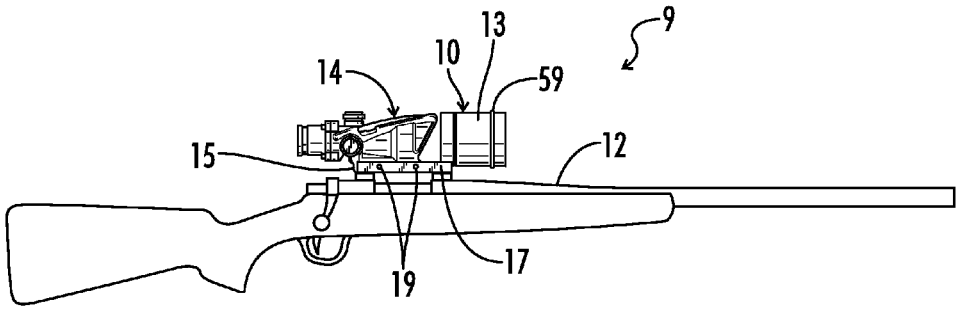
FIG. 1 is a side view of an exemplary embodiment of a weapon system having a scope correction apparatus mounted on a rifle.

FIG. 1 depicts an exemplary embodiment of a weapon system 9 having a scope correction apparatus 10 mounted on a rifle 12. The apparatus 10 comprises a lens housing 13 having one or more lenses (not shown in FIG. 1), and the lens housing 13 is positioned in front of a reticled scope 14 mounted on the rifle 12. In the embodiment shown by FIG. 1, the scope correction apparatus 10 is secured to a base 15 of the scope 14 via one or more attachment bars 17 and a plurality of screws 19, discussed in more detail hereafter, but other techniques for mounting the apparatus 10 on the rifle 12 are possible in other embodiments. For example, the apparatus 10 may be attached to a barrel or other portion of the rifle 12 in other embodiments. Furthermore, while the scope correction apparatus 10 is shown and described herein with respect to use on the rifle 12, the apparatus 10 may be used with other types of weapons (not shown) having scopes 14.

The scope correction apparatus 10 is configured to receive light from a scene and to alter the light before the light passes to the scope 14 such that optical aberrations caused by a short distance between the scope and scene are corrected. For example, in an indoor facility or other environment, the scope 14 may be used to view an image of a scene rendered on a display structure (not shown in FIG. 1), such as a screen or wall, that is a relatively short distance from the scope 14 compared to the distances for which the scope is designed to view. In such case, without the presence of the apparatus 10 to alter the light from the display structure, the focal point of the light might not be overlaid with the scope reticle depending on the distance between the scope 14 and the display structure causing the image of such reticle to appear out of focus (blurry) to the user. Also, any lateral or angular movement of the rifle 12 might not mimic reality when viewed through the scope 14 due to the differences between the actual size and the apparent size of the target. For example, if the user is viewing the scene through the scope 14 without the apparatus 10 attached to the rifle 12, a slight angular movement of the rifle 12 may cover a larger degree of the scene than would occur in reality thereby adversely affecting the realism of the rendered scene.

In one embodiment, the apparatus 10 collimates the received light such that rays (not shown in FIG. 1) of the light are substantially parallel as they enter the scope 14, as will be discussed in more detail hereafter. In other words, the optics of the apparatus 10 has an effective focal length that causes the scene to appear to be a greater distance from the scope 14 than it actually is. Thus, a clear image of the scene passes through the scope 14 and has a focal point at the location of the reticle thereby allowing both the scene image and the reticle image to appear in focus to the user.

Furthermore, in one embodiment, the apparatus 10 demagnifies the light, as will be discussed in more detail hereafter. Such demagnification allows the size of the target image projected on the display structure to be increased without unrealistically increasing the size of the image seen by the user through the scope 14 relative to an embodiment that uses a smaller target image without demagnification by the apparatus 10. Increasing the target image projected on the display structure and counteracting such increase with demagnification by the apparatus 10 more accurately mimics perceived lateral movement of the scope 14 relative to the projected image, as will be described in more detail hereafter.

Though the weapon system 9 may be used for a variety of purposes, in one exemplary embodiment, the weapon system 9 is used in a firearm training simulation environment. In such environment, an image projector (not shown in FIG. 1) displays an image of a scene on a display structure (not shown in FIG. 1), and a user of the weapon system 9 can elect to view the scene with his or her naked eye or view the scene through the scope 14 and the scope correction apparatus 10. The objects displayed in the scene are preferably sized such that they appear realistic regardless of whether the user is viewing the scene with his or her naked eye or through the scope 14 and the scope correction apparatus 10. Such an environment can be used to simulate real-world situations thereby facilitating firearm training for the user. As an example, for a hunter, a scene of a forest with one or more animals (e.g., deer) visible within the forest may be presented to the user. For a soldier, a scene of a battlefield or an armed conflict may be presented. In such situations, the user may practice handling the rifle 12 as he or she would when encountering similar scenes in real life, thereby helping to train the user. Also, the user is afforded the opportunity of using the training environment to test and/or evaluate the weapon system 9. As an example, a potential purchaser of the rifle 12 may use the rifle 12 in the simulated training environment to assist him or her in deciding whether to purchase the rifle 12. In other examples, other uses of the weapon system 9 are possible.

Preferably, the scope correction apparatus 10 is temporarily mounted on the rifle 12 (e.g., removably coupled to the scope 14, as shown by FIG. 1) for use in the simulated training environment. While mounted on the rifle 12, the scope correction apparatus 10 corrects for the relatively short distance between the scope 14 and the display structure on which the scene is rendered. After use in the training environment, the scope correction apparatus 10 may be removed for allowing the scope 14 to be used without correction in long range applications for which the scope 14 was originally designed.

Figure 2:
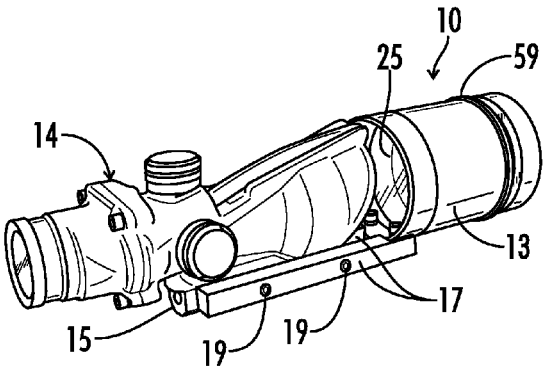
FIG. 2 is a perspective view of the exemplary scope and scope correction apparatus of FIG. 1.
Figure 3:
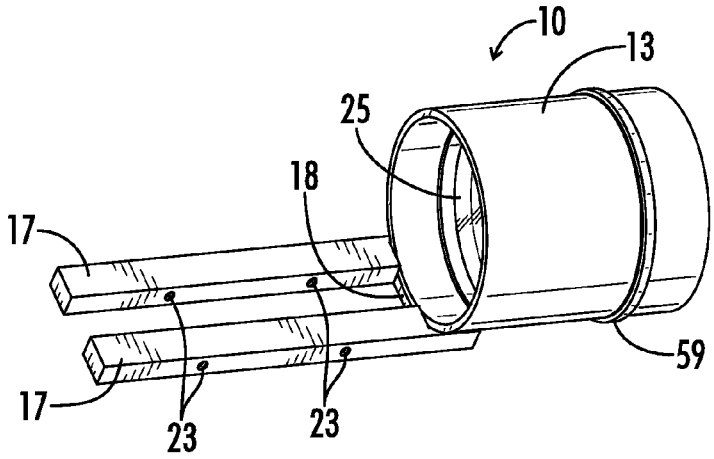
FIG. 3 is a perspective view of the exemplary scope correction apparatus of FIG. 1.

FIG. 2 depicts a perspective view of the scope correction apparatus 10 and scope 14 of FIG. 1. As set forth above, the apparatus 10 is secured to the base 15 of the scope 12 via one or more attachment bars 17, which are connected to one another via a support tab 18 (FIG. 3). The lens housing 13 is mounted on the bars 17 at the location of the tab 18, which provides mechanical support to the bars 17 at about the mounting location of the lens housing 13. As shown by FIG. 2, the parallel attachment bars 17 extend tangentially from an outer surface of the lens housing 13 with the base 15 of the scope 14 positioned snugly between the bars 17 so that frictional forces between the base 15 and bars 17 hold the apparatus 10 in place. In one embodiment, screws 19 extend through the attachment bars 17 and abut an outer surface of the base 15 on opposing sides of the base 15, which may be mounted on the rifle 12 via conventional techniques or otherwise. The ends of the screws 19 abutting the base 15 are flat and press against the base 15 helping to secure the apparatus 10 to the base 15. However, other techniques for mounting the apparatus 10 on the rifle 12 and/or attaching the apparatus 10 to the scope 14 are possible in other embodiments. Furthermore, while two attachment bars 17 and four screws 19 are used in the exemplary embodiment depicted by FIG. 2, other numbers of bars 17 and screws 19 may be used in other embodiments.

The apparatus 10 is secured to the base 15 such that the lens housing 13 is positioned in front of the scope 14. Thus, light from a scene is received by the apparatus 10 and passes through the lens housing 13 and is altered by the optics of the apparatus 10 before being received by the scope 14, as will be described in more detail hereafter. Note that angular and lateral alignment (centration) of the apparatus 10 relative to the scope 14 is not critical to performance. However, it is generally desirable to have the apparatus diameter overfill the input diameter of the scope 14.

FIG. 3 depicts the exemplary scope correction apparatus 10 of FIG. 1 before the apparatus 10 is mounted on the rifle 12. As set forth above, the apparatus 10 comprises a lens housing 13 positioned upon laterally extending attachment bars 17. The attachment bars 17 are secured to an outer surface of the housing 13 via welding, gluing, or some other suitable attachment process, and the bars 17 extend in parallel from a rear of the housing 13. In one embodiment, the bars 17 comprise metal, such as steel or aluminum, but different materials, including plastics, are possible in other embodiments. The bars 17 are spaced apart such that a gap 21 is formed between the bars 17 for receiving the base 15 (FIG. 1) of the scope 14 (FIG. 1). Screws 19 (not shown in FIG. 3) may be respectively inserted into threaded channels 23 of the bars 17 in order to help secure the apparatus 10 to the rifle 12.

The scope correction apparatus 10 comprises at least one lens 25 positioned within the lens housing 13, as will be described in more detail below. Such lens or lenses receive light from scene, such as an image of a target displayed on a structure, and collimate the light for presentation to the scope 14 (FIG. 1) so that the scope 14 focuses the light at the location of its reticle (not shown in FIG. 1). In one embodiment, a plurality of lenses are positioned within the housing 13, and the distance between at least two lenses is adjustable to allow adjustment of the effective focal length of the apparatus 10, as will be described in more detail hereafter. Thus, the effective focal length may be dynamically changed in order to accommodate different distances between the apparatus 10 and the display structure on which the scene image is rendered. That is, the effective focal length of the apparatus 10 can be selected by varying the distance between lenses so that the focal length of the apparatus 10 substantially matches the distance from the display structure to the apparatus 10. Thus, the scene and reticle images that are presented to the user through the scope 14 should be clear (in focus) despite a short distance between the scope 14 and the display structure.

Figure 4:
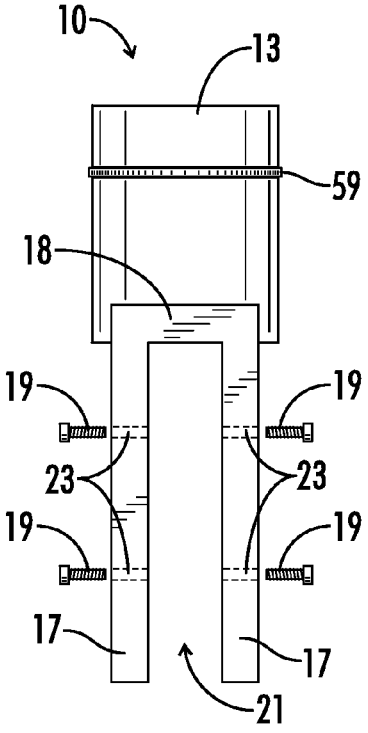
FIG. 4 is a bottom view of the exemplary scope correction apparatus of FIG. 1.

FIG. 4 depicts a bottom view of the scope correction apparatus 10 of FIG. 3. As set forth above, the attachment bars 17 are secured to a bottom surface of the lens housing 13 and extend rearwardly from the housing 13. The bars 17 are spaced apart from one another such that a gap 21 is formed between the bars 17, and the gap 21 is dimensioned to receive the base 15 (FIG. 1) of the scope 12 (FIG. 1). The tab 18 connects the bars 17 and provides mechanical support to the bars 17. Each bar 17 has one or more threaded channels 23 extending horizontally through the bar 17 for receiving the screws 19. When the base 15 is positioned within the gap 21, the screws 19 may extend through the channels 23 and contact the base 15 to help secure the apparatus 10 to the rifle 12, as will be described in more detail hereafter.

Figure 5:
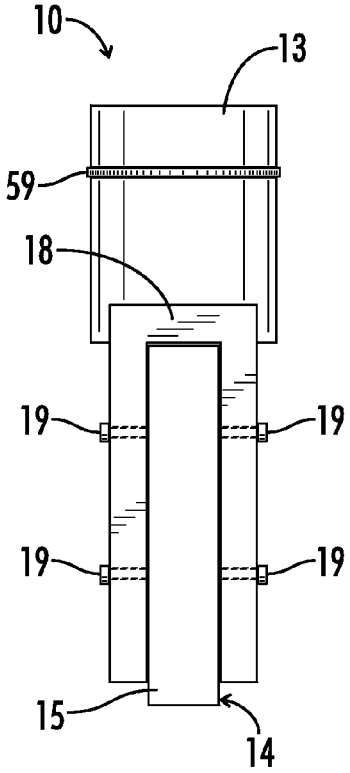
FIG. 5 is a bottom view of the exemplary scope correction apparatus of FIG. 1 mounted on a scope.

FIG. 5 depicts a bottom view of the scope correction apparatus 10 of FIG. 3 secured to a scope 14. In FIG. 5, the base 15 of the scope 14 is positioned within the gap 21 (FIG. 3) and abuts the tab 18 such that the lens housing 13 is positioned in front of the scope 14. Once the lens housing 13 is positioned in a desirable location with respect to the scope 14 (FIG. 1), each screw 19 is inserted into a respective threaded channel 23 (FIG. 4) such that an end of each screw 19 extends through the channel 23 and presses against an outer surface of the base 15 on a side of the base 15. In other embodiments, other techniques and devices for securing the apparatus 10 to the rifle 12 are possible.

Once the apparatus 10 is secured to the base 15, the user may adjust the effective focal length of the apparatus 10 (in embodiments that permit adjustment to the effective focal length) and/or the distance between the apparatus 10 and the display structure so that a focused images of both the scene and the reticle are presented to the user through the scope 14.

Figure 6:
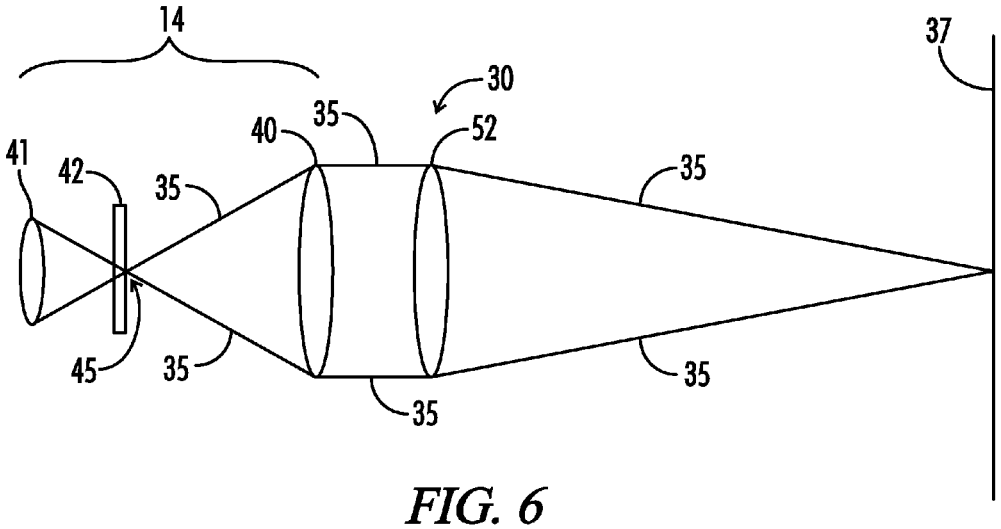
FIG. 6 is a block diagram illustrating an exemplary embodiment of optics for a scope and a scope correction apparatus, such as is depicted by FIG. 1.

FIG. 6 depicts an exemplary embodiment of exemplary optics 30 for a scope 14 and a scope correction apparatus 10 positioned in front of the scope 14. In one embodiment, the apparatus 10 comprises a single lens 52, and such lens 52 receives rays 35 of light from a scene, such as an image of a target displayed on a display structure 37 by an image projector (not shown) or some other device for rendering images. The lens 52 collimates the light such that rays of light exiting the apparatus 10 are substantially parallel.

In addition, the scope 14 typically comprises at least an objective lens 40, an eyepiece 41, and a reticle 42 within an optical path for light received from the scope correction apparatus 10. In one embodiment, the reticle 42 comprises glass having a design, such as, for example, cross-hairs or other patterns, etched into the glass, but different types of reticles 42 are possible in other embodiments. When the light entering the objective lens 40 is collimated (e.g. the rays 35 are parallel to one another), the rays 35 intersect with one another within the scope 14 and form a focal point 45 at the reticle 42, as shown by FIG. 6. Thus, when the user views the target image through the scope 14, both the target image and the reticle 42 are in focus such that the user can aim the rifle 12 (FIG. 1) accurately. However, if the light entering the objective lens 40 is not collimated, such as, for example, when the apparatus 10 is not positioned in front of the scope 14 and there is a short distance between the scope 14 and the display structure 37, the focal point 45 is not at the reticle 42, and the target and the reticle 42 are not simultaneously in focus to a user of the scope 14. In such case, the target or the reticle 42 appears undesirably blurry to the user.

Note that, in the embodiment depicted by FIG. 6, the effective focal length of the apparatus 10 and, specifically, the lens 52 is ideally equal to the distance between the lens 52 and the display structure 37 for presentation to the scope 14. In this regard, the closer that the focal length of the lens 52 matches the distance from the lens 52 to the display structure 37, the better the apparatus 10 collimates the light from such structure 37. Hence, the clarity of the image presented to the users is generally improved the closer that such distance matches the focal length of the lens 52. Moreover, if the focal length of the lens 52 is not approximately equal to the distance between the lens 52 and the display structure 37, then the light exiting the lens 52 will not be collimated causing the focal point 45 to be located either further back or more forward in the scope 14, depending on whether the apparatus 10 is over or under-correcting for the distance between the lens 52 and the display structure 37, away from the reticle 42 such that the focal point 45 and the reticle 42 are not overlaid. In such case, the user can adjust his or her eyesight to bring into focus either the reticle image or the scene image, but not both.

The embodiment set forth in FIG. 6 facilitates accurate perception of angular movement for the rifle 12 and scope 14. In this regard, the lens 52 does not magnify or de-magnify the image of the scene passing through it. That is, the magnification factor of the lens 52 is "1×" such that the size of the image is not altered by the lens 52. In such case, the size of the target image displayed on the structure 37 can be controlled by an image projector (not shown) to be realistic when viewed with the user's naked eye. In this regard, by reducing the size of the target image on the structure 37, the displayed target appears to be further away. For the embodiment depicted by FIG. 6, the size of the target image is preferably controlled such that the target appears to the user to be a certain distance when looking at the target image without the scope 14. By viewing the target image through the scope 14, the target image is magnified by the scope, as would be the case in real life when the scope 14 is used to view an actual target that is at the same distance away as that simulated by the rendered image. In such an embodiment, the perception of angular movement of the rifle and scope 14 is perfectly realistic. That is, a given angular movement (rotation) of the scope 14 about the focal point 45 should displace the target image by the same amount for the same angular movement when viewing an actual target at the same distance as that simulated by the rendered image. Accordingly, perceived angular movements of the rifle 12 mimic reality when the user is looking through the scope 14 to view the rendered image for the embodiment depicted by FIG. 6.

However, lateral perception for the rifle 12 and scope 14 is skewed in the embodiment depicted by FIG. 6. In this regard, if the scope 14 is moved laterally (e.g., left, right, up, or down) without rotating the scope 14, the target image is displaced by a much greater amount than would occur if the scope 14 is laterally moved by the same amount while viewing an actual target at the same distance as that simulated by the rendered image. To make lateral movement more realistic, the apparatus 10 could be modified to de-magnify the target image. For perfectly realistic lateral movement, the de-magnification of the apparatus 10 could be the exact opposite of the magnification provided by the scope 14. For example, if the scope magnification is "4×" such that the scope 14 magnifies the image passing through it by a factor of four, then apparatus 10 may be arranged to de-magnify the image by a factor of four such that the overall magnification of the scope 14 and apparatus 10 is "1×" (i.e., no net magnification change). Generally, up to the point that the de-magnification of the apparatus 10 is equal to the magnification of the scope 14, the realism for lateral movement generally increases the more that that apparatus 10 de-magnifies the target image, but such realism gains are achieved at the cost of realism for angular displacement. In this regard, for ideal angular displacement, the magnification factor of the apparatus 10 is one ("1×"), and the realism for angular displacement generally decreases the further that magnification factor of the apparatus 10 gets from its ideal value of one. Thus, a trade-off exists between the quality of angular displacement perception and the quality of lateral movement perception.

Moreover, the amount of de-magnification, if any, introduced by the apparatus 10 is preferably selected as a design consideration between the competing interests of angular displacement perception and lateral movement perception. An exemplary embodiment of providing de-magnification will be described in more detail below with reference to FIG. 9.

Figure 7:
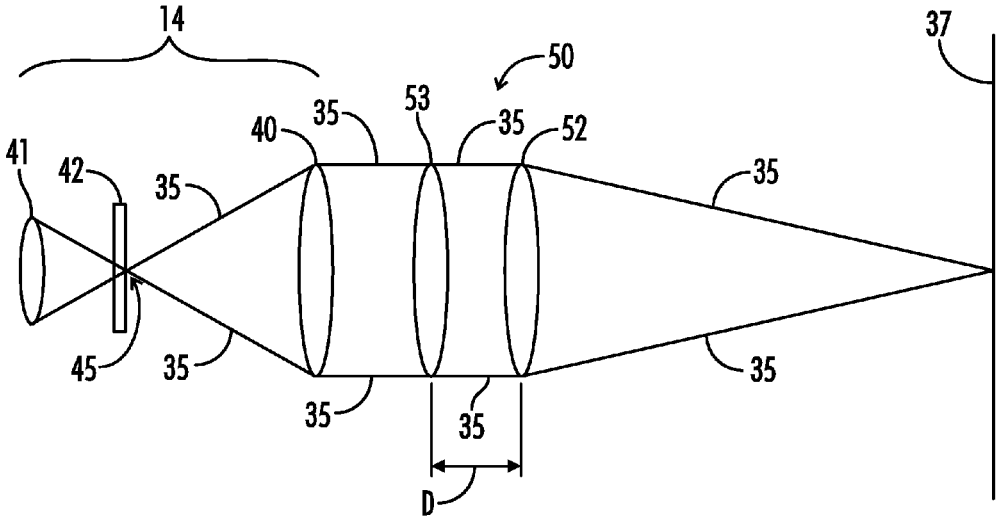
FIG. 7 is a block diagram illustrating another exemplary embodiment of optics for scope and a scope correction apparatus, such as is depicted by FIG. 1.

FIG. 7 depicts another exemplary embodiment of optics 50 for a scope 14 and a scope correction apparatus 10 positioned in front of the scope 14. In one embodiment, the apparatus 10 comprises a pair of lenses 52, 53, and such lenses 52, 53 receive rays 35 of light from a scene, such as an image of a target displayed on a display structure 37. The lenses 52, 53 collimate the light such that rays of light exiting the apparatus 10 are substantially parallel. In this regard, the effective focal length of the apparatus 10 is approximately equal to the distance of the lens 53 from the display structure 37 so that the light passing through the apparatus 10 is collimated. Like the embodiment depicted by FIG. 6, there is no magnification of the light passing through the apparatus. 10. That is, the lenses 52, 53 are preferably of equal size (e.g., have the same focal length) such that the magnification factor for the two lenses 52, 53 is one ("1×"). Thus, angular movement of the rifle 12 and scope 14 mimics reality to the user when the user views the target through the scope 14, as set forth above for the embodiment of FIG. 6.

Furthermore, in the embodiment depicted by FIG. 7, the scope correction apparatus 10 may be adjusted to provide corrected light to the scope 14 at a range of distances. In this regard, the effective focal length of the apparatus 10 may be adjusted by adjusting the distance "D" between the lenses 52, 53. If the focal lengths of the two lenses 52, 53 are of opposite sign and the distance D is increased, then the effective focal length of the apparatus 10 decreases. However, if the distance D is decreased, then the effective focal length of the apparatus 10 increases. Accordingly, for a given distance between the apparatus 10 and the display structure 37, the user may adjust the distance D until the effective focal length of the apparatus 10 is approximately equal to the distance between the lens 52 and the display structure 37. In one embodiment, the effective focal length of the scope correction apparatus 10 is set forth using standard relations for the sum of two thin lenses, yielding the following equation:

$$EFL_S=(EFL_1*EFL_2)/(EFL_1+EFL_2-D),$$

wherein $EFL_S$ is the effective focal length of the apparatus 10, $EFL_1$ is the effective focal length of the front lens 52, $EFL_2$ is the effective focal length of the back lens 53, and D is the distance between the lenses 52, 53. Thus, the apparatus 10 may be configured such that $EFL_1$ is approximately equal to $-EFL_2$. In such embodiment, $EFL_S$ is infinite when D is approximately equal to zero, and $EFL_S$ decreases as D increases.

When the effective focal length of the apparatus 10 ($EFL_S$) is approximately equal to the distance between the lens 52 and the display structure 37, the apparatus 10 presents collimated light to the scope 14 such that the focal point 45 of the scope 14 is located at the reticle 42, and the target image and the reticle image are simultaneously in focus to the user. The user may select the appropriate distance D by viewing the target through the scope 14 and adjusting the distance D until the target and the reticle 42 appear in focus to the user, or these distances can be measured and marked on the retaining structure for respacing when the distance is known.

Figure 8:
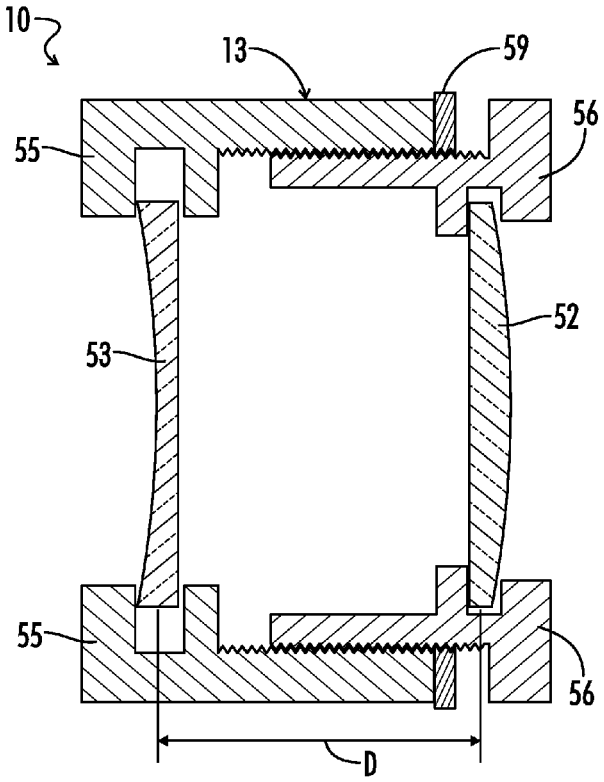
FIG. 8 is a side cutaway view of an exemplary embodiment of a scope correction apparatus, such as depicted by FIG. 1, having optics as depicted by FIG. 7.

FIG. 8 depicts a side cutaway view of the scope correction apparatus 10 having optics 50 in accordance with the embodiment of FIG. 7. The apparatus 10 comprises two lenses 52, 53 as set forth above, positioned within a lens housing 13. In one embodiment, each lens 52, 53 is positioned within and held by a respective section 55 and 56 of the housing 13. In this regard, one lens 53 is positioned within and held by the section 55, and the other lens 52 is positioned within and held by the section 56. Further, the sections 55 and 56 are arranged to move longitudinally with respect to one another in order to facilitate adjustment of the distance D between the lenses 52, 53. In one embodiment, the sections 55 and 56 are cylindrical in shape and an inner surface of the section 55 and an outer surface of the section 56 are threaded such that the sections 55 and 56 are threadedly coupled to one another and can be rotated with respect to one another in order to adjust the distance D. For example, in one embodiment, rotating the section 55 in a clockwise direction with respect to the section 56 decreases the distance D, and rotating the sections 55 in a counterclockwise direction with respect to the section 56 increases the distance D. However, other techniques and devices for adjusting the distance D are possible in other embodiments.

As set forth above, by increasing the distance D between the lenses 52, 53, the effective focal length of the apparatus 10 is decreased. Also, by decreasing the distance D between the lenses 52, 53, the effective focal length of the apparatus 10 is increased. Therefore, the apparatus 10 may be used to provide corrected light to the scope 14 for a range of distances. For example, in one embodiment, the apparatus 10 may be configured to operate in a range of approximately 5 feet to approximately 14 feet, but other ranges are possible. In such embodiment, one lens 52 may comprise a plano-convex lens having a diameter of about 50 millimeters (mm) and a focal length of about 250 mm, and the other lens 53 may comprise a plano-concave lens having a diameter of about 50 mm and a focal length of about −250 mm. However, different types of lenses 52, 53 and ranges are possible in other embodiments.

In one exemplary embodiment, the apparatus 10 has a locking element 59 for locking at least one movable lens 52, 53. In this regard, once the lenses 52, 52 are suitably positioned for a desired distance D between the lenses 52, 53, the locking element 59 is actuated in order to lock the relative positions of the lenses 52, 53 so that the distance D is not inadvertently altered. In the exemplary embodiment illustrated by FIG. 8, the locking element 59 comprises a jam nut, but other types of locking elements 59 are possible in other embodiments. The exemplary locking element 59 of FIG. 8 forms a ring having an interior surface that is threaded for threadedly coupling the element 59 to the section 56. The locking element 59 can be rotated (screwed) such that it presses against the element 55, thereby locking the position of the movable lens 52 relative to the lens 53.

Figure 9:
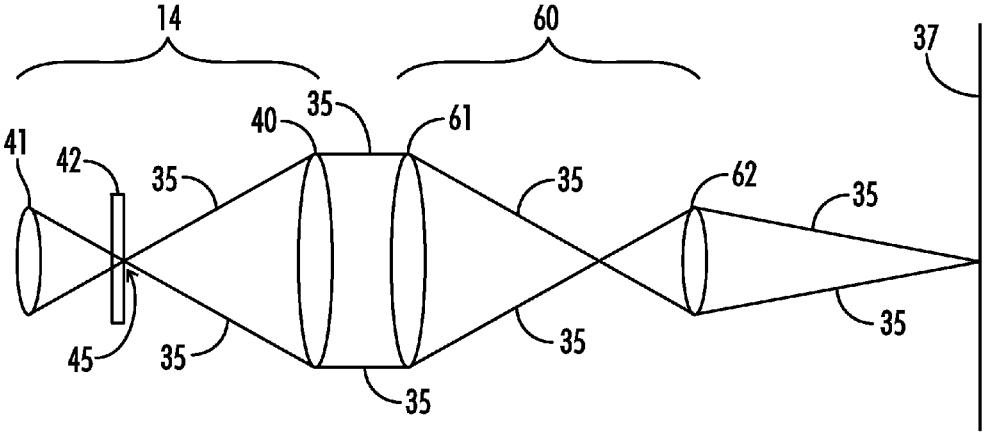
FIG. 9 is a block diagram illustrating yet another exemplary embodiment of optics for a scope and a scope correction apparatus, such as is depicted by FIG. 1.

FIG. 9 depicts another exemplary embodiment of optics 60 for a scope 14 and a scope correction apparatus 10 positioned in front of the scope 14. For such embodiment, the scope correction apparatus 10 comprises a large lens 61 of focal length $EFL_A$ and a small lens 62 of focal length $EFL_B$ wherein the small lens 62 is oriented towards the display structure 37 and the large lens 61 is oriented towards the scope 14. The focal length of the small lens 62 is less than the focal length of the large lens 61, and the lenses 61 and 62 are positioned a certain distance apart in order to achieve a desired demagnification of the light received from the target on the display structure 37. For such embodiment, the scope correction apparatus 10 is configured to de-magnify light received from a target image rendered on the display structure 37 by a factor of $EFL_B/EFL_A$ and to correct the light entering the scope 14 in order to facilitate lateral movement of the scope 14 such that the lateral movement mimics reality. In this regard, the apparatus 60 adjusts the focal plane of the scope 14 and collimates the rays 35 of light received from the target image such that the target image is in focus to the scope 14 (e.g., the focal point 45 is located at the reticle 42) and de-magnifies the scene presented on the display structure 37 before it is passed to the scope 14. Note that the lenses 61, 62 can be single lens elements, or multiple lens elements, with adjustments to accommodate variable magnification and different distances between the apparatus 60 and the display structure 37.

The ratio between the focal length of the large lens 61 and the focal length of the small lens 62 is selected to provide a desired amount of demagnification. As described previously above, the amount of de-magnification introduced by the apparatus 10 affects the quality of angular displacement perception and lateral movement perception. Further, the lenses 61, 62 may be mounted in a lens housing 13, similar to the lenses 52, 53 of FIG. 8, in order to allow a user to adjust the distance between the lenses 61, 62, thereby accommodating various distances between the apparatus 10 and the structure 37.

In one exemplary embodiment, assume that an image of a scene is rendered on the display structure 37 by an image projector (not shown) or some other device for rendering images. Further, assume that the scene includes an image of a deer as a target for the user of the rifle 12. Such deer is preferably sized within the image to appear to be a great distance from the user, such as 100 feet or more, when viewed with the user's naked eye. However, assume that the user is actually at a much smaller distance, such as less than 20 feet, from the structure 37 on which the scene is rendered. Thus, upon viewing the scene image through the scope 14 without the scope correction apparatus 10, the light entering the scope 14 from the displayed scene is not collimated due to the short distance between the structure 37 and the scope 14, and the image from the objective lens 40, referred to as the "intermediate image," is not focused on the reticle 42. Thus, the user is unable to view a clear image of both the reticle 42 and the target (e.g., the displayed deer in this example).

Now assume that the scope correcting apparatus 10 having optics in accordance with FIG. 7 is positioned upon the rifle 12. In this regard, the scope 14 is mounted to the rifle 12 and the user positions the base 15 of the scope 14 within the gap 21 between the attachment bars 17 such that the lens housing 13 is positioned a desired distance in front of the scope 14. The user inserts the screws 19 into the respective threaded channels 23 and tightens the screws 19 such that an end of each screw 19 and an inner surface of each bar 17 tightly hug an outer surface of the base 15 thereby securing the apparatus 50 to the base 15 of the scope 14.

Once the apparatus 50 is secured to the base 15, the user positions the rifle 12 to view the displayed image of the deer through the scope 14. If the effective focal length of the apparatus 10 ($EFL_S$) is approximately equal to the distance between the apparatus 50 and the display structure 37, then the apparatus 10 appropriately collimates the light from the rendered scene such that the focal point 45 of such light within the scope 14 is located at the reticle 42. Accordingly, both the displayed deer and the reticle image should be in focus to the user, and any angular movement of the rifle 12 mimics reality to the user viewing the target through the scope 14.

However, if $EFL_S$ is not approximately equal to the distance between the apparatus 50 and the display structure 37, then the image of the deer or the reticle image will likely appear out of focus to the user. In such case, the user may adjust the distance D between the lenses 52 by rotating the section 56 with respect to the section 55 in order to adjust $EFL_S$. In this regard, the user increases $En_S$ by decreasing D, and the user decreases $EFL_S$ by increasing D. The user views the target through the scope 14 and adjusts D until both the target and the reticle 42 are in focus in order to determine the appropriate $EFL_S$.

Once the appropriate $EFL_S$ is determined, the apparatus 50 presents collimated light to the scope 14 such that the focal point of the light received from the target is located at the reticle 42. Accordingly, the reticle 42 and the target are in focus to the user and the user can accurately aim at the target. Furthermore, any angular movement of the rifle 12 by the user is ideal such that the angular movement mimics reality to the user as he or she looks through the scope 14.

Various embodiments illustrated above include a scope 14 and scope correction apparatus 10 mounted on a rifle 12. In other embodiments, the scope 14 and scope correction apparatus 10 may be mounted on other types of ballistic weapons (e.g., pistols or other types of guns).

Now, therefore, the following is claimed:

1. A scope correction method, comprising:

mounting a scope correction apparatus on a ballistic weapon between a scope mounted on the ballistic weapon and an end of a barrel of the ballistic weapon;

rendering an image of a scene on a surface;

positioning the ballistic weapon such that the scope correction apparatus receives light from the image, wherein the light received by the scope correction apparatus is not collimated;

collimating the light via the scope correction apparatus such that the light is focused at a focal point of the scope, wherein the focal point is located at a reticle within the scope, receiving the collimated light at the scope; and magnifying an image defined by the collimated light via the scope subsequent to the collimating.

2. The scope correction method of claim 1, further comprising de-magnifying the light collimated by the scope correction apparatus.

3. The scope correction method of claim 1, wherein the scope correction apparatus has a lens, and wherein a focal length of the lens is substantially equal to a distance between the surface and the lens.

4. The scope correction method of claim 1, wherein the mounting comprises removably coupling the scope correction apparatus to the scope.

5. The scope correction method of claim 1, wherein the scope correction method is for use in a firearm training simulation environment having an image projector and a display structure, wherein the display structure comprises the surface, and wherein the rendering comprises displaying the image via an image projector on the surface of the display structure.

6. The scope correction method of claim 1, wherein the scope correction apparatus has a first bar and a second bar separated by a gap, and wherein the mounting comprises positioning the scope correction apparatus such that a base of the scope is between the first and second bars.

7. The scope correction method of claim 6, further comprising:

passing a screw through one of the bars; and contacting the base of the scope with the screw.

8. The scope correction method of claim 1, wherein the scope correction apparatus has a first lens and a second lens.

9. A scope correction method, comprising:

mounting a scope correction apparatus on a ballistic weapon between a scope mounted on the ballistic weapon and an end of a barrel of the ballistic weapon, wherein the scope correction apparatus has a first lens and a second lens, and wherein the second lens has a focal length smaller than a focal length of the first lens;

rendering an image of a scene on a surface;

positioning the ballistic weapon such that the scope correction apparatus receives light from the image, wherein the light received by the scope correction apparatus is not collimated; and collimating the light via the scope correction apparatus such that the light is focused at a focal point of the scope, wherein the focal point is located at a reticle within the scope.

10. A scope correction method, comprising:

mounting a scope correction apparatus on a ballistic weapon between a scope mounted on the ballistic weapon and an end of a barrel of the ballistic weapon, wherein the scope correction apparatus has a first lens and a second lens, and wherein the second lens has a focal length equal to a focal length of the first lens;

rendering an image of a scene on a surface;

positioning the ballistic weapon such that the scope correction apparatus receives light from the image, wherein the light received by the scope correction apparatus is not collimated; and collimating the light via the scope correction apparatus such that the light is focused at a focal point of the scope, wherein the focal point is located at a reticle within the scope.

11. A scope correction method, comprising:

mounting a scope correction apparatus on a ballistic weapon between a scope mounted on the ballistic weapon and an end of a barrel of the ballistic weapon, wherein the scope correction apparatus has a first lens and a second lens;

rendering an image of a scene on a surface;

positioning the ballistic weapon such that the scope correction apparatus receives light from the image, wherein the light received by the scope correction apparatus is not collimated;

collimating the light via the scope correction apparatus such that the light is focused at a focal point of the scope, wherein the focal point is located at a reticle within the scope; and moving the first lens relative to the second lens.

12. The scope correction method of claim 11, further comprising locking a position of the first lens relative to a position of the second lens.

13. The scope correction method of claim 12, wherein the locking comprises rotating a jam nut.

* * * * *